US006349896B1

(12) United States Patent
Adcock et al.

(10) Patent No.: US 6,349,896 B1
(45) Date of Patent: Feb. 26, 2002

(54) METHOD OF CONTROLLING STRAND GUIDE POSITION DURING PACKAGE BUILDUP

(75) Inventors: Joseph Anthony Adcock, Heath; Clark Thomas Forbes, Newark, both of OH (US); Douglas Brian Mann, Evans, GA (US); Juan-Carlos Maymir, Pickerington, OH (US); Keith Brian Richey, Anderson, SC (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/531,380

(22) Filed: Mar. 21, 2000

(51) Int. Cl.[7] ..... B65H 54/40; B65H 54/28

(52) U.S. Cl. ..... 242/485.1; 242/483.5; 242/486.4

(58) Field of Search ..... 242/485.1, 486.4, 242/480.3, 483.5, 483.7

(56) References Cited

U.S. PATENT DOCUMENTS

| | | | | | |
|---|---|---|---|---|---|
| 2,545,534 | A | * | 3/1951 | Truitt | 242/485.1 X |
| 3,365,145 | A | | 1/1968 | Klink et al. | |
| 3,367,587 | A | | 2/1968 | Klink et al. | |
| 3,371,877 | A | | 3/1968 | Klink et al. | |
| 3,523,650 | A | | 8/1970 | Klink et al. | |
| 3,547,361 | A | | 12/1970 | Klink | |
| 3,717,311 | A | | 2/1973 | Smith | |
| 3,801,032 | A | | 4/1974 | Sears et al. | |
| 3,838,827 | A | | 10/1974 | Klink et al. | |
| 3,854,668 | A | | 12/1974 | Rudd | |
| 3,897,021 | A | | 7/1975 | Shape | |
| 4,061,285 | A | | 12/1977 | Powers, Jr. | |
| 4,294,416 | A | | 10/1981 | Beckman | |
| 4,304,364 | A | * | 12/1981 | Busch | 242/486.4 |
| 4,371,122 | A | | 2/1983 | Schuller | |
| 4,396,162 | A | | 8/1983 | Braziel | |
| 4,436,258 | A | | 3/1984 | Jackson et al. | |
| 4,715,548 | A | | 12/1987 | Miyake et al. | |
| 5,033,685 | A | | 7/1991 | Busenhart et al. | |
| 5,100,072 | A | | 3/1992 | Behrens et al. | |
| 5,853,133 | A | | 12/1998 | Smith | |
| 6,059,217 | A | * | 5/2000 | Ludwig et al. | 242/486.4 X |
| 6,161,790 | A | * | 12/2000 | Westrich | 242/486.4 |
| 2001/0007339 | A1 | * | 7/2001 | Flamm et al. | 242/486.4 |

* cited by examiner

*Primary Examiner*—Michael R. Mansen
(74) *Attorney, Agent, or Firm*—Inger H. Eckert

(57) ABSTRACT

A collet is rotated to wind a strand and build a package. The strand is reciprocated with a strand reciprocator having a strand guide to lay the strand in a pattern on the package surface as the package rotates. As the package builds, the diameter of the package increases. A method includes a startup procedure for selecting a desired rotational speed or torque of the collet prior to building the package. As the package builds, the torque on the collet is monitored and kept within upper and lower operating curves to control the package density. The method can also monitor the torque of the cam and/or receder to control the force exerted by the strand guide on the package.

8 Claims, 7 Drawing Sheets

METHOD OF CONTROLLING STRAND GUIDE POSITION DURING PACKAGE BUILDUP

TECHNICAL FIELD

This invention relates to the production of glass fibers, and in particular, to winding a glass fiber strand to form packages. More particularly, this invention relates to controlling the position of the strand guide with respect to the collet for optimum package buildup.

BACKGROUND OF THE INVENTION

Mineral fibers are used in a variety of products. The fibers can be used as reinforcements in products such as plastic matrices, reinforced paper and tape, and woven products. During the fiber forming and collecting process numerous fibers are bundled together as a stand. Several strands can be gathered together to form a roving used to reinforce a plastic matrix to provide structural support to products such as molded plastic products. The strands can also be woven to form a fabric, or can be collected in a random pattern as a fabric. The individual strands are formed from a collection of glass fibers, or can be comprised of fibers of other materials such as other mineral materials or organic polymer materials. A protective coating, or size, is applied to the fibers which allows them to move past each other without breaking when the fibers are collected to form a single strand. The size also improves the bond between the strands and the plastic matrix. The size may also include bonding agents which allow the fibers to stick together, thereby forming an integral strand. It is to be understood that the use of a size is optional.

Typically, continuous fibers, such as glass fibers, are mechanically pulled from a feeder of molten glass. The feeder has a bottom plate, or bushing, which has anywhere from 200 to 10,000 orifices. In the forming process, the strand is wound around a rotating drum, or collet, to form, or build, a package. The completed package consists of a single long strand. It is preferable that the package be wound in a manner which enables the strand to be easily unwound, or paid out. It has been found that a winding pattern consisting of a series of helical courses laid on the collet builds a package which can easily be paid out. Such a helical pattern prevents adjacent loops or wraps of strand from fusing together should the strand be still wet from the application of the size material. The helical courses are wound around the collet as the package begins to build. Successive courses are laid on the outer surface of the package, continually increasing the package diameter, until the winding is completed and the package is removed from the collet.

A strand reciprocator guides the strand longitudinally back and forth across the outer surface of the package to lay each successive course. A known strand reciprocator is the spiral wire type strand oscillator. It consists of a rotating shaft containing two outboard wires approximating a spiral configuration. The spiral wires strike the advancing strand and direct it back and forth along the outer surface of the package. The shaft is also moved longitudinally so that the rotating spiral wires are traversed across the package surface to lay the strand on the package surface. While building the package, the spiral wire strand oscillator does not contact the package surface. Although the spiral wire strand oscillator produces a package that can be easily paid out, the package does not have square edges.

A known strand reciprocator which produces square edged, cylindrical packages includes a cam having a helical groove, a cam follower which is disposed within the groove and a strand guide attached to the cam follower. As the cam is rotated, the cam follower and strand guide move the strand longitudinally back and forth across the outer surface of the rotating package to lay each successive course. A rotatable cylindrical member, or roller bail, contacts the outer surface of the package as it is being built to hold the strand laid in the latest course in place at the package edges as the strand guide changes direction. The roller bail is mounted for rotation, and bearings are used to reduce the friction between the roller bail and the mounting surface. The collet and package are rotating at high speeds during winding. The contact between the roller bail and the rotating package surface causes the roller bail to rotate, and the speed of the roller bail surface is generally equal to the high rotational speed of the package surface. The roller bail has a fixed diameter which is generally less than the diameter of the collet, and may be only 10% of the collet diameter. Therefore, the roller bail must rotate at higher revolutions per minute (RPMs) to keep the roller bail surface traveling at the same speed as the speed of the package surface. To operate effectively throughout the preferred range of package sizes and preferred collet speeds during winding the roller bail may have to rotate at 70,000 RPMs or higher.

The rotating rollers of the roller bails contact the strand as it is laid on the package surface. If the speed of the roller bail surface does not match the speed of the package surface, the roller bail will apply abrasive forces against the strand, and this can break some of the fibers in the strand. Bearings are provided between the roller bail mounts and the rotating roller bail to reduce friction and allow the roller bail to rotate at high RPMs. Typical grease lubricated bearings which have been used in the past have been found not to reduce the friction enough to allow the roller bails to operate at such high RPMs without causing abrasive forces against the strand which can break strand fibers. The strand reciprocator has other moving parts in addition to the roller bails with surfaces which need lubrication. The rotating cam has bearings which use lubrication. The cam follower needs lubrication while it moves along the groove on the cam surface.

Several attempts have been made to control the strand guide or guide eye position during package buildup. For example, U.S. Pat. No. 3,854,668 to Rudd appears to disclose a yam winder that establishes an absolute position by moving the guide eye into contact with the collet and then zeroing out a potentiometer.

U.S. Pat. No. 4,715,548 to Miyake et al. appears to disclose a winding process in which a controller 8 computes the diameter of the package during the winding process, using the rotational speed of the package and the input signal from the inverter to the motor.

U.S. Pat. No. 3,365,145 to Klink et al. appears to disclose a winder that maintains the guide eye close to the package, but backs off the guide eye in response to the increased size of the package. The backing off is effected with a spring 92 connected via a microswitch 96 to a backoff motor 96.

It has been found that a lack of control of the strand guide position with respect to the collet poses several problems, including but not limited to, partial break out of filaments at the bushing, a bushing tension increase, a potential mechanical failure on the turret system or collet spindle, a worn or damaged strand guide assembly, and lubrication failures. Thus, it would be desirable to control the relative position of the strand guide with respect to the collet and to monitor the force applied to the package by the strand guide during the packaging process.

SUMMARY OF THE INVENTION

This invention relates to a method of controlling the position of the strand guide during package buildup, the method comprises the steps of:

rotating a collet for building a package;

rotating a cam having a strand guide for winding a strand on the rotating collet;

moving the rotating cam radially toward the rotating collet until the strand guide contacts the rotating collet;

monitoring a torque on the collet as the strand guide contacts the collet; and moving the rotating cam radially away from the rotating collet until a desired torque on the collet is reached.

In an alternative method of the invention, the method comprises the steps of:

rotating a collet for building a package;

rotating a cam having a strand guide for winding a strand on the rotating collet;

moving the rotating cam with a receder toward the rotating collet until the strand guide contacts the rotating collet;

determining a torque on one of the collet, the cam and the receder as the strand guide contacts the collet; and Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
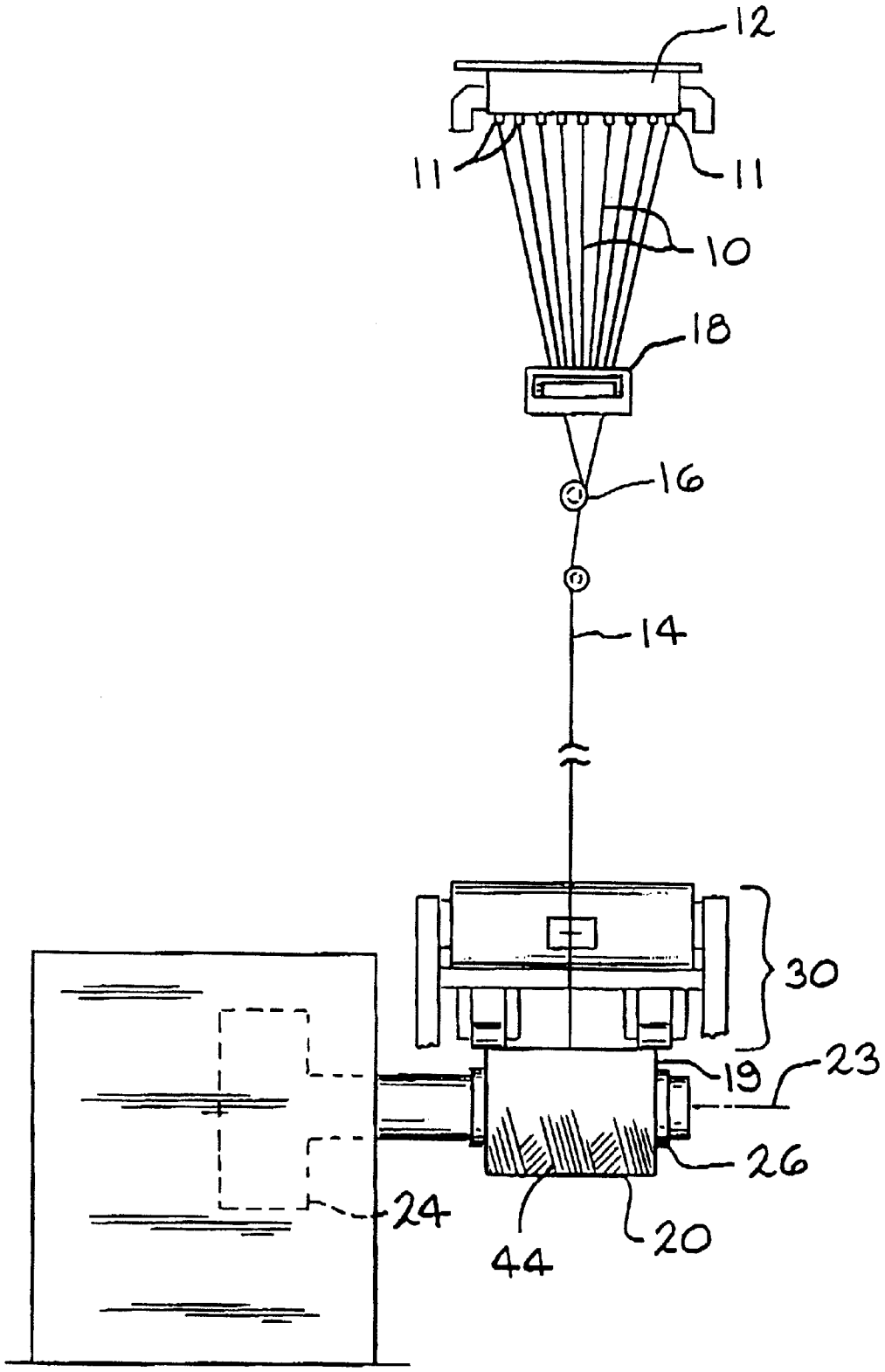
FIG. 1 is a schematic view in elevation of apparatus for forming, collecting and winding fiber strands according to the principles of the invention.
Figure 2:
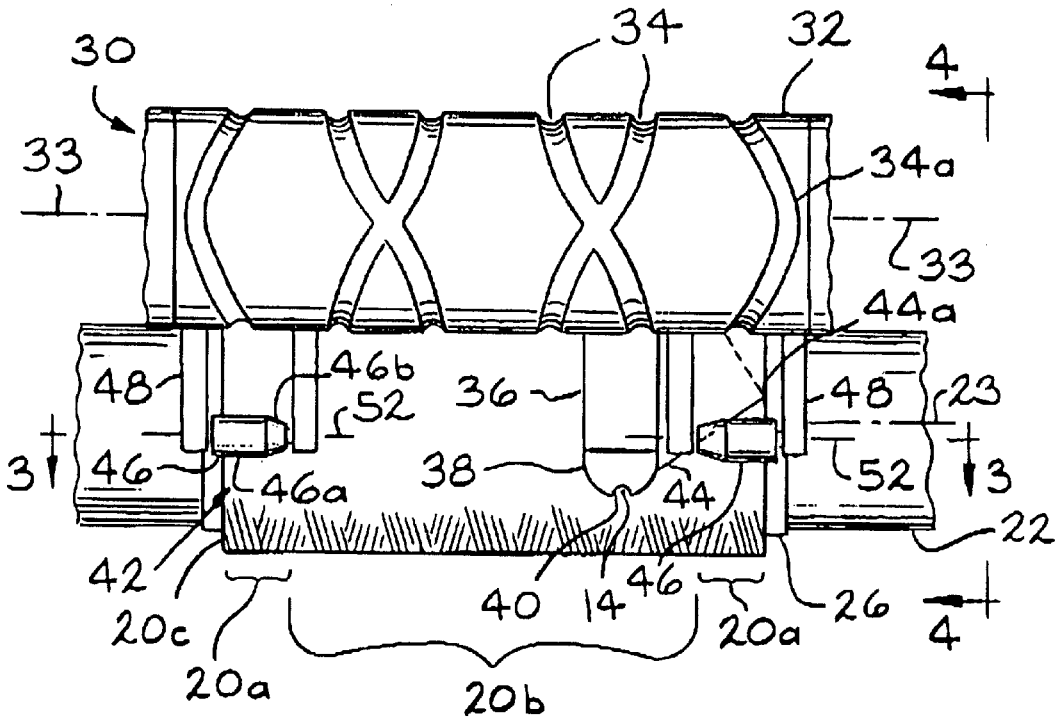
FIG. 2 is an enlarged, plan view of the strand reciprocator shown in FIG. 1.

FIGS. 1 and 2 show an apparatus for forming, collecting, and winding strands in which fibers 10 are drawn from a plurality of orifices 11 in a bushing 12 and gathered into a strand 14 by means of a gathering member 16. A size suitable for coating the fibers can be applied to the fibers by any suitable means, such as size applicator 18. The strand is wound around a rotating collet 22 to build a cylindrical package 19. The package, formed from a single, long strand, has a radially outer surface 20 with edge portions 20*a* and a central portion 20*b* between them. The edge portions 20*a* form generally right angles with the package ends 20*c*. The outer surface of the cylindrical package is preferably between about 10 cm to about 40 cm long, but may be longer or shorter depending on the application. The collet is adapted to be rotated about an axis of rotation 23 by any suitable means such as a motor 24. Any suitable package core material such as a cardboard tube 26 can be disposed on the collet to receive the strand package.

Referring now to FIG. 2, a strand reciprocator 30 guides the strand 14 laterally back and forth across the package surface 20 to lay the strand in courses 44 on the package surface. The strand reciprocator includes a cylindrical cam 32 having a helical groove 34. The cam is mounted for rotation and preferably made of a hard material, such as stainless steel, but any suitable material can be used. The strand reciprocator further includes a cam follower 36 disposed in the groove 34. The cam follower extends outwardly from the cam and a strand guide 38 is attached to the end. The cam follower is preferably made of a plastic or nylon material, but any suitable material can be used. A notch 40 is formed in the strand guide to hold the strand 14. Rotation of the cam causes the cam follower to follow the helical groove, thereby causing the strand guide to move laterally across the package surface.

Figure 3:
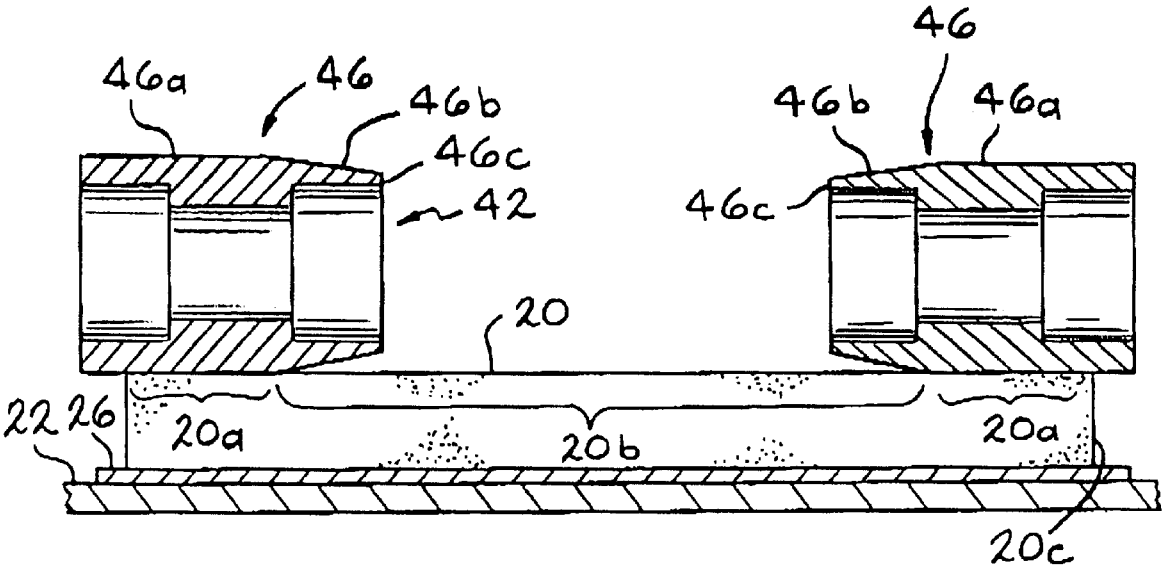
FIG. 3 is a schematic sectional view in elevation of the apparatus of FIG. 2, taken along line 3–3.

Referring now to FIGS. 2 and 3, the strand reciprocator further includes a roller bail assembly 42 for holding the strand courses 44 in place at the edge portions 20*a* of the package surface 20 as the strand guide 38 changes direction. The roller bail assembly includes a pair of spaced apart, or split rollers 46. The rollers have generally cylindrical edge ends 46*a* and tapered inner ends 46*b*. The cylindrical edge ends contact the package surface at the edges 20*a*. The tapered inner ends extend from the edge ends towards the central portion of the package surface 20*b*. The rollers do not contact the surface of the package at the central portion of the package 20*b*. Each of the rollers 46 is independently mounted by mounts 48. One or more bearings 50 are located between the roller bails and the mounts to allow the roller bails to rotate freely by reducing friction. The bearings are preferably open, ball bearing type bearings. Although the roller bails are shown as mounted at both the edge ends and the inner ends, the roller bails may be cantilevered, being mounted at only one end. Each roller is made from a hard material, such as stainless steel, but any suitable material may be used. The rollers preferably weigh approximately 50 grams each, but may be heavier or lighter depending on their size and the application. They are preferably hollow to minimize weight and inertia, but may be solid. Each roller is preferably about 2 cm long, but they may be longer or shorter depending on the application.

The split roller bails are preferably coaxial, contacting the package surface along a portion of a line 52 which is generally parallel to the package axis of rotation 23, although, any suitable orientation of the roller bails may be used. Using 2 cm long roller bails, the length of contact between the roller bails and the typical package surface will be approximately 10% to 50% of the length of the outer surface of the package. A longer or shorter length of contact between the roller bails and the package surface may be used depending on the application.

Figure 4:
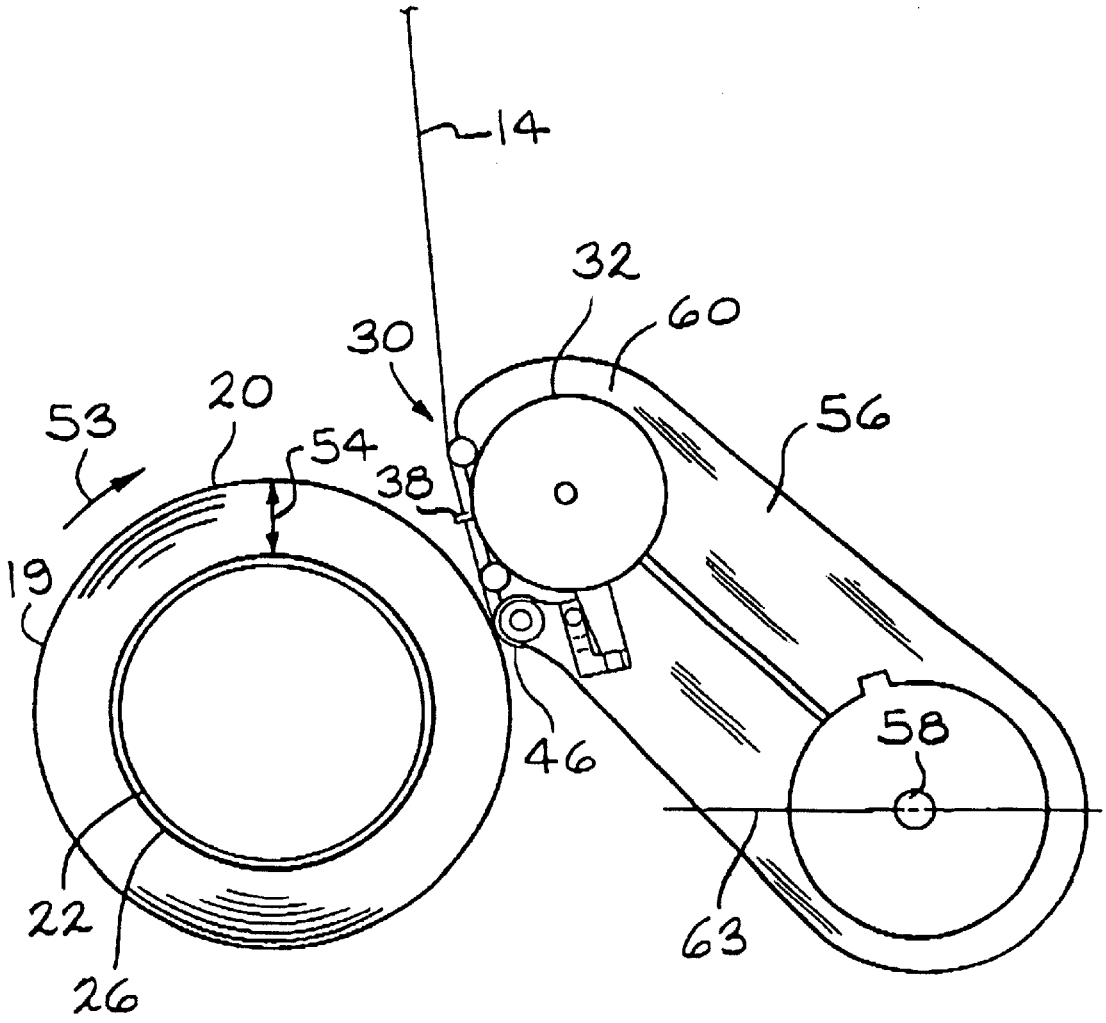
FIG. 4 is an end view in elevation of a portion the roller bail assembly of FIG. 1.

The package rotates during winding as shown by line 53 in FIG. 4. As the package builds, the radius 54 increases. To accommodate the increasing package radius, the strand reciprocator 30 is mounted on an arm 56. To accommodate the increasing package radius, the arm moves away from the collet along line 63 to keep the proper contact between the surface of the rollers and the package surface, and to prevent the strand courses 44 from pulling away from the edge portions 20*b* of the package surface.

Figure 5:
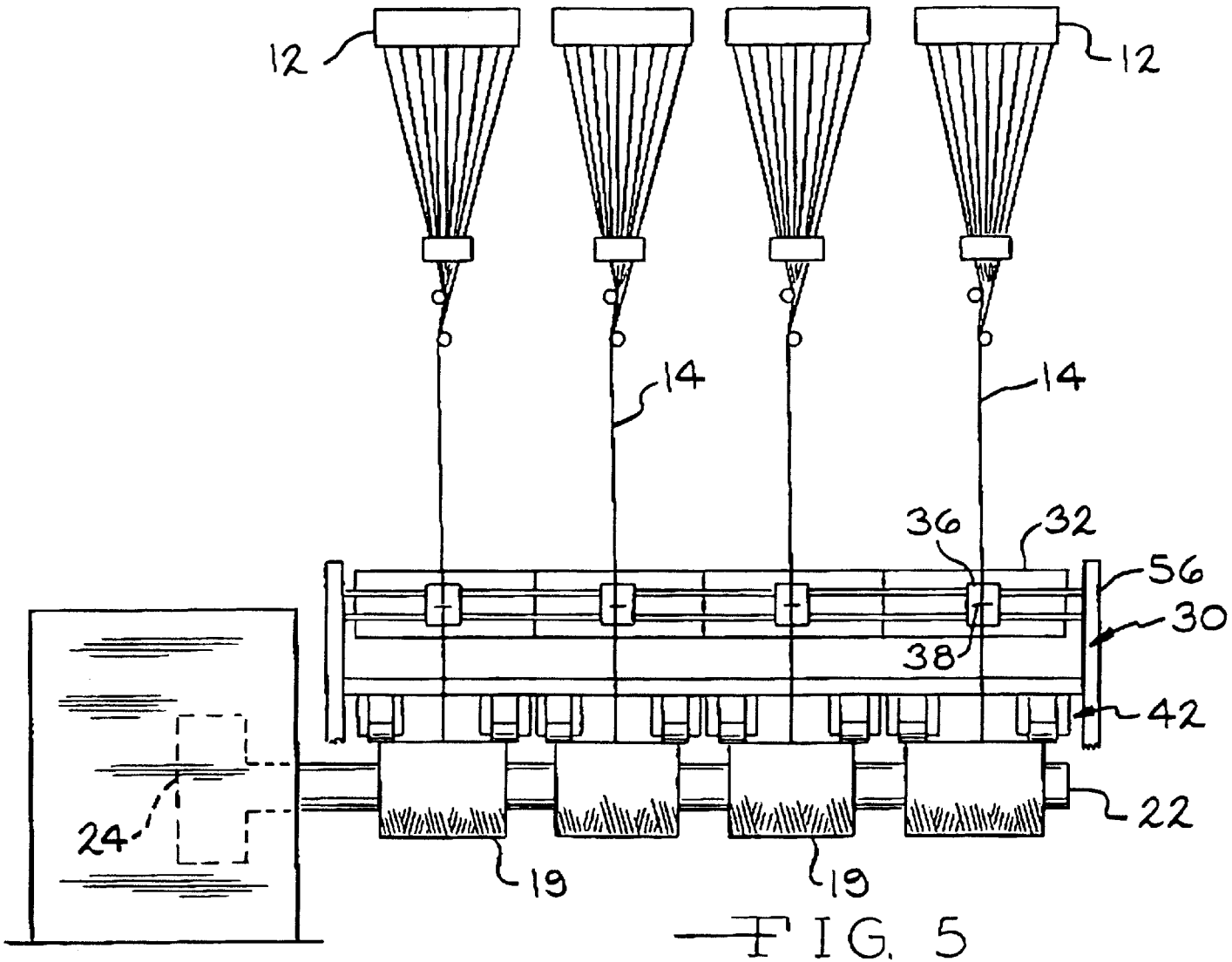
FIG. 5 is a diagrammatic view of an alternate embodiment of the invention showing the building of multiple packages on a single collet.

Several packages can be built simultaneously on the collet, as shown in FIG. 5. Each package is built by drawing separate strands 14 from separate bushing sections. The strands are wound around a single collet 22 to form packages 19. A separate strand reciprocator, including cam 32, cam follower 36, strand guide 38 and roller bail assembly 42, is used to build each package. The packages are spaced apart along the collet and the strand reciprocators are spaced along the arm 56 in a similar manner so as to be aligned with the packages.

In operation, the strand reciprocator 30 guides the strand 14 as it is laid on the outer surface of the package. The strand is held by notch 40 in the guide eye or strand guide 38 and wound around the rotating collet 22 or a package core 26 disposed about the collet. The cam 32 is oriented near the package and rotates about the axis 33 generally parallel to the package axis of rotation 23. The cam follower is disposed within the cam groove 34, but is prevented from rotating with the cam. As the cam rotates, the cam follower is moved laterally by the helical groove in a direction generally parallel to the package axis of rotation 23. The helical groove is continuous, having curved ends 34*a* that cause the cam follower to move to the end of the package and then reverse direction. The strand guide 38 is attached to the cam follower and it traverses the outer surface of the package, reciprocating back and forth from end to end. The strand guide 38 contacts the surface of the package as it traverses the outer surface of the package.

The helical winding pattern of each strand course 44 is formed by reciprocating the strand across the package surface while rotating the package. As the strand guide 38 approaches the edge portions 20*a* of the package, the strand is laid on the package surface under the roller tapered inner ends 46*b*. The strand guide 38 continues to move towards the package ends 20*c* and the strand course, shown in phantom at 44*a* in FIG. 2, moves between the package surface and the cylindrical edge end 46*a* of the roller which is in contact with the package surface. When the cam follower travels through the curved end 34*a* of the groove 34, the strand guide 38 changes direction and moves away from the package end 20*c* and towards the central portion of the package 20*b*. The contact between the roller bails of the strand guide 38 and the package surface holds the strand course 44*a* in place at the edge of the package surface 20*a*, when the strand guide 38 changes direction. By preventing the strand courses 44*a* from pulling away from the package ends 20*c* as the strand guide moves back towards the center of the package 20*b*, a cylindrical package having square edges 20*c* is built. It will be appreciated that it is not necessary for the roller bails to contact the package surface for building a cylindrical package having square edges 20*c*. A preferred method of forming the cylindrical package is to have the strand guide 38 contacting the package surface. As the package increases in diameter, the strand guide 38 must be backed off radially away from the package to maintain the desired amount of force against the package.

Figure 6:
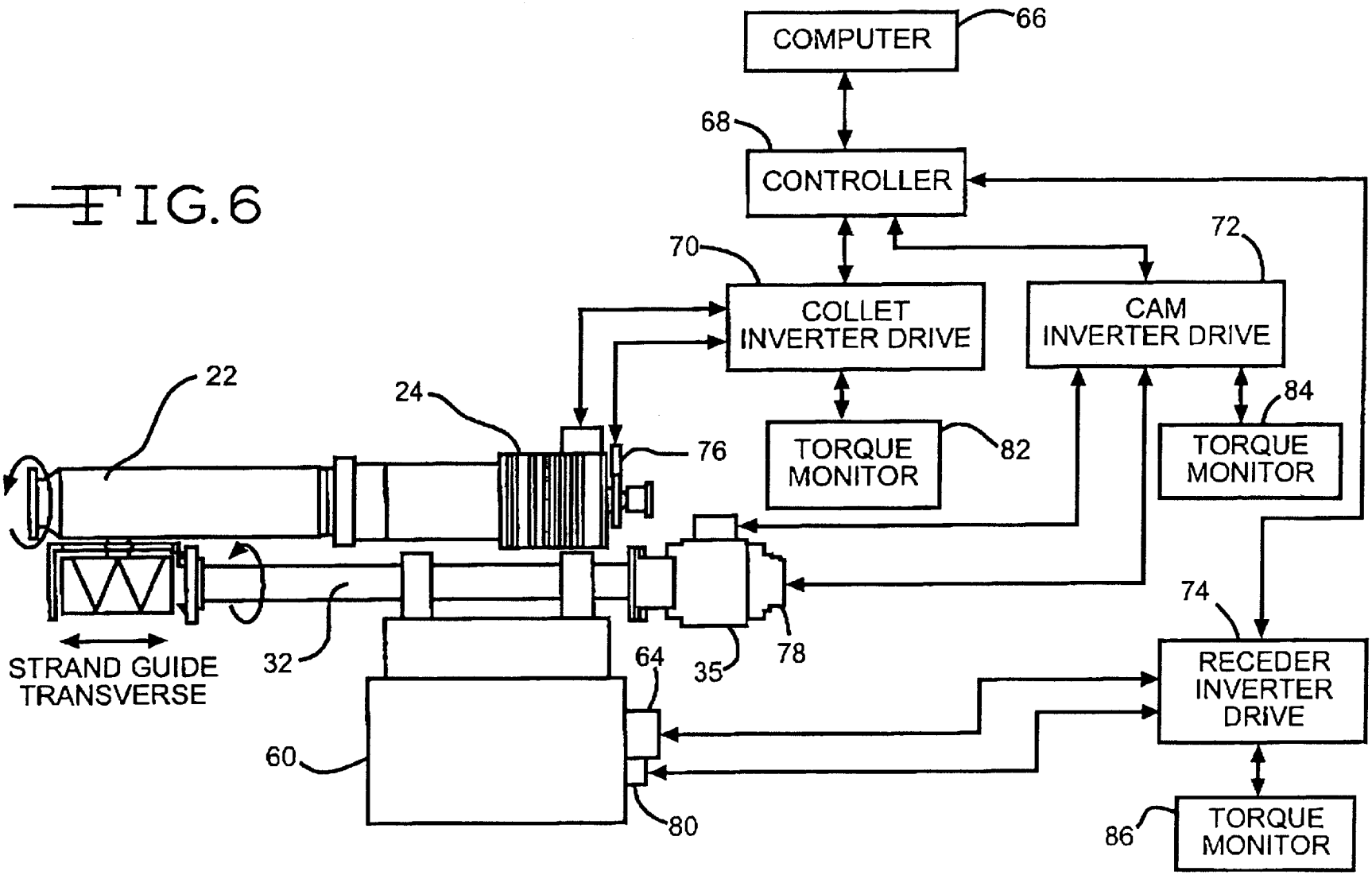
FIG. 6 is a block diagram of the control system for the method of the invention.
Figure 7:
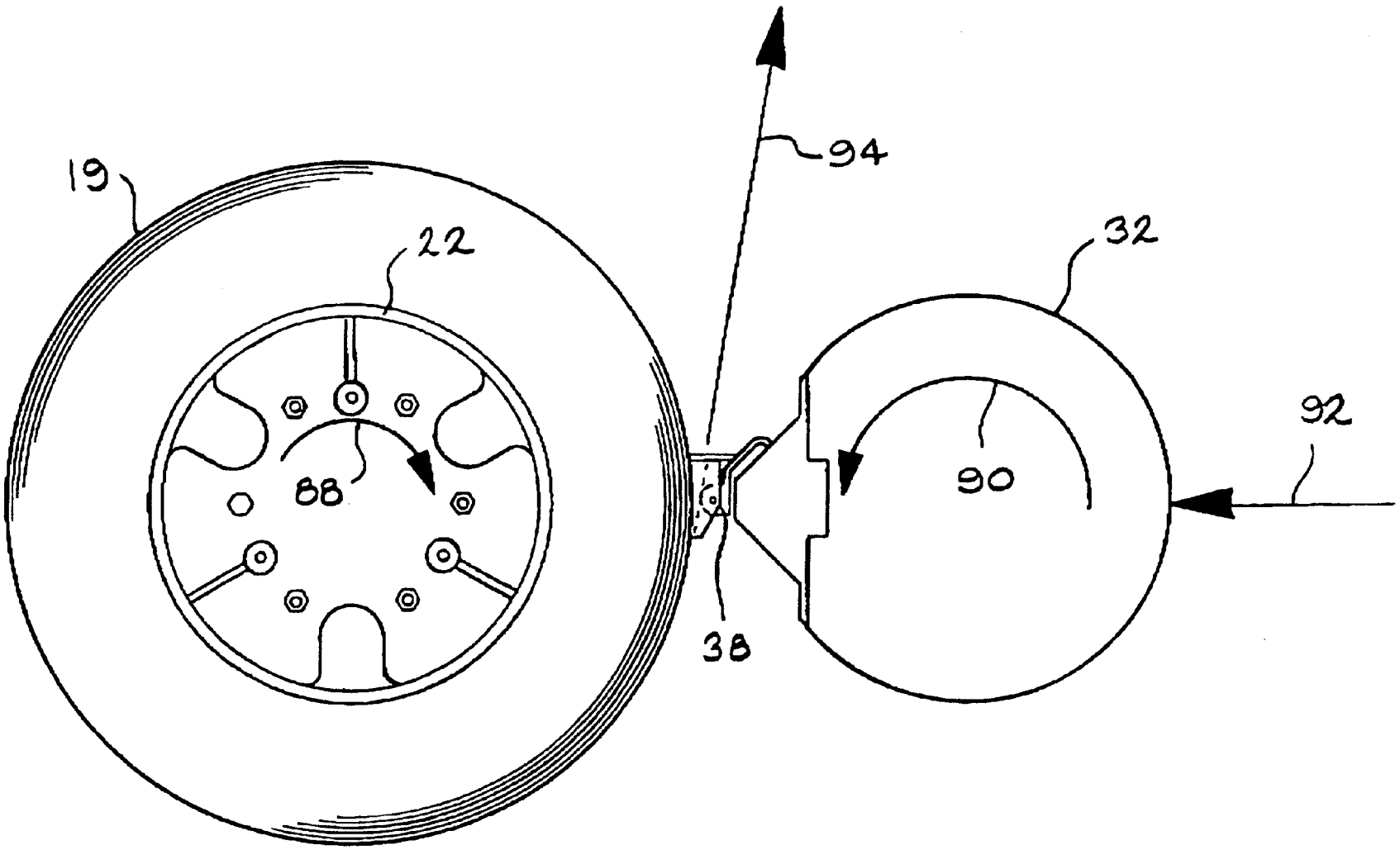
FIG. 7 is a diagram of the forces exerted by the strand guide on the package during package buildup.

Referring now to FIGS. 6 and 7, the apparatus of the invention further includes a cam receder 60 for positioning the cam 32 with respect to the collet 22. The receder 60 includes a motor 64, preferably a servo motor, to move the cam 22 radially toward or away from the package during package buildup. The apparatus further includes a memory storage device 66, such as a personal computer for storing data and executing a computer program. The computer 66 is operatively connected to a controller 68 such as a programmable logic controller (PLC). The computer 66 can provide the controller 68 with a series of reference values for the rotational speed of the collet, the cam and the receder motors 24, 35, 64 as a function of time for the package buildup. These reference values may be contained in one or more lookup tables.

The controller 68 is also operatively connected to a collet inverter drive 70 for driving the motor 24, a cam inverter drive 72 for driving the motor 35, and a receder inverter drive 74 for driving the motor 64. The inverter drives 70, 72 are capable of controlling the motors 24, 35 to select a rotational speed of the collet and the cam, respectively. The inverter drive 74 is capable of controlling the radial position of the cam 32 with respect to the collet 22. Each motor 24, 35 may be equipped with an encoder 76, 78 to provide feedback information to the controller 68 relating to the rotational speed of the motors 24, 35. The motor 64 may be equipped with an encoder 80 to provide feedback information to the controller 68 relating to the position of the cam 32 with respect to the collet 22.

A torque monitor 82 may be operatively connected to the collet inverter drive 70 to receive the feedback information from the encoder 76 relating to the rotational speed of the collet 22. Specifically, the force exerted by the strand guide 38 on the package will result in a change of the rotational speed of the collet 22. The torque monitor 82 uses this change in the rotational speed of the collet 22 to determine a torque 88 on the collet inverter drive 70, as shown in FIG. 7. Similarly, a torque monitor 84 may be operatively connected to the cam inverter drive 72 to monitor the torque exerted by the strand guide 38 on the cam inverter drive 72. Likewise, a torque monitor 86 may be operatively connected to the receder inverter drive 74 to monitor the force exerted by the strand guide 38 on the receder inverted drive 74. In addition, a force 94 is also exerted by the strand 14 on the package during package buildup. This force 94 increases during package buildup due to the increase in the package diameter.

It is highly desirable to maintain a constant amount of force exerted by the strand guide 38 against the package during package buildup. To accomplish this, the invention contemplates a two-step method for precisely controlling the amount of force exerted by the strand guide 38 against the package during package buildup. In general, the two-step method comprises the steps of: (1) performing a setup procedure to determine a relative position of the collet and the cam in which the strand guide exerts a predetermined amount of force against the package to establish a reference position of the strand guide with respect to the collet, and (2) monitoring the force applied to the package by the strand guide to maintain a constant force exerted by the strand guide on the package during package buildup.

As mentioned above, the first step of the method of the invention involves performing a setup procedure to determine a relative position of the collet 22 and the cam 32 in which the strand guide 38 exerts a predetermined force against the package to establish a reference position of the strand guide 38 with respect to the collet 22. Preferably, the setup procedure is performed before package buildup to control the density of the package during package buildup. To perform the setup procedure, the receder 60 moves the cam 32 in incremental steps toward the collet 22 until the strand guide 34 is brought into contact with the collet 22. This contact is sensed by the torque monitor 82 as a change in the rotational speed of the collet 22. Then, the receder 60 moves the cam 32 away from the collet 22 until the desired amount of force is exerted by the strand guide 38 on the collet 22. This startup procedure enables the extraneous variables, such as lubrication, spring rate of various parts, and the like, which affect the exact position of the strand guide 38 to be filtered out before the beginning of the winding process.

Figure 8:
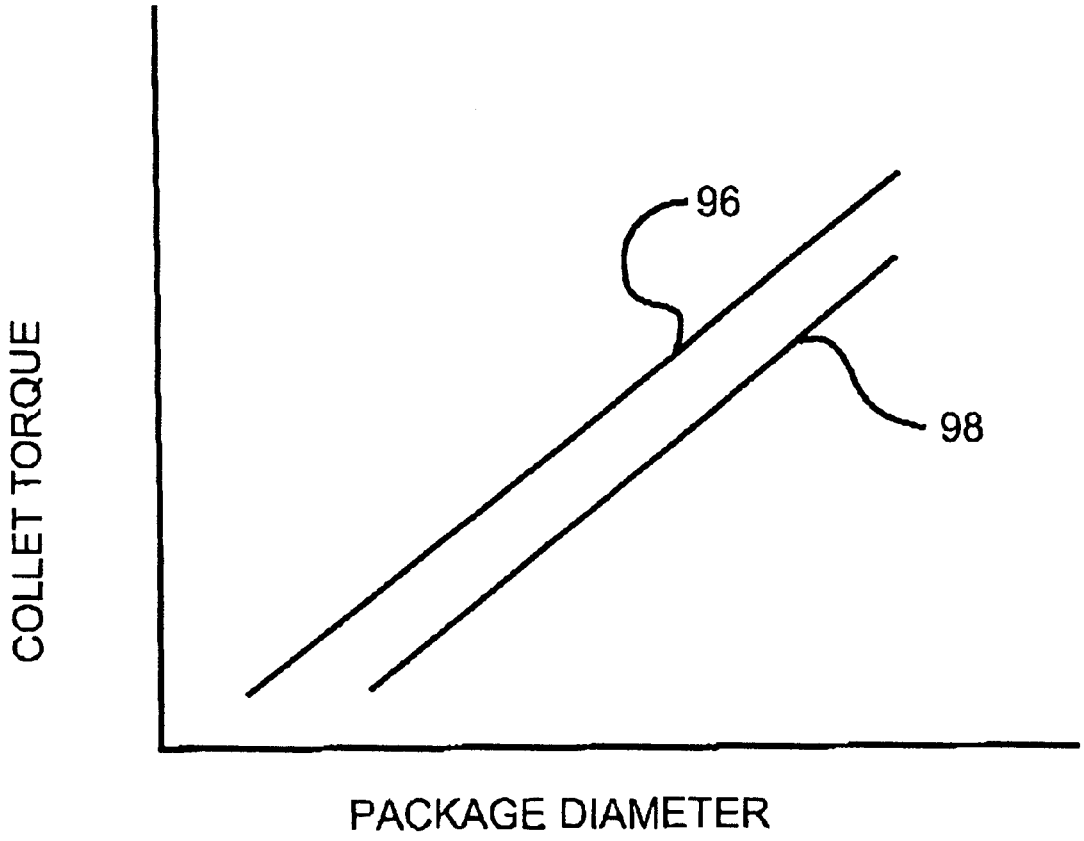
FIG. 8 is a graph of torque on the collet as a function of package diameter according to the method of the invention.

The second step of the method of the invention can be performed in a variety of different ways. Referring now to FIG. 8, the preferred method of the invention can use reference values stored in the computer 66 for the torque on the collet 22 and/or collet motor 24 as a function of package diameter to maintain a constant force exerted by the strand guide 38 on the package by moving the cam 32 and the strand guide 38 radially away from the collet 22 during package buildup. As shown in FIG. 8, the torque 88 on the collet 22 linearly increases as a function of package diameter. However, it will be appreciated that this function may be linear or non-linear. Preferably, the torque on the collet 22 as a function of package diameter can be defined by an upper operating curve 96 and a lower operating curve 98. The desirable torque on the collet 22 during package buildup is defined as the torque between the upper and lower operating curves 96, 98 for a particular package diameter. A torque outside the operating curves 96, 98 would be undesirable. By using the feedback information from the encoder 76, the receder 60 can be programmed to move the cam 32 toward or away from the collet 22 such that the torque on the collet 22 falls within the upper and lower operating curves 96, 98. An alarm (not shown) could be initiated when the torque on the collet 22 is outside the upper and lower operating curves 96, 98. It will be appreciated that this method of the invention can use the torques 90, 92 of the cam 32 and/or the receder 60, respectively, rather than the torque 88 on the collet 22.

As described above, the method of the invention alleviates problems associated with conventional winders by controlling the pressure exerted by the strand guide on the package during package buildup to prevent partial break out of filaments at the bushing, a bushing tension increase, a potential mechanical failure on the turret system or collet spindle, a worn or damaged strand guide assembly, or lubrication failures.

Although the invention has been described with reference to glass fibers, it is to be understood that the invention could be used with other mineral fibers, or with organic fibers, or with combinations of fibers.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of controlling strand guide position during package buildup on a strand winder, the method comprising the steps of:

rotating a collet for building a package;

rotating a cam having a strand guide for winding a strand on the rotating collet;

moving the rotating cam radially toward the rotating collet until the strand guide contacts the rotating collet;

monitoring a torque on the collet as the strand guide contacts the collet; and moving the rotating cam radially away from the rotating collet until a desired torque on the collet is reached.

2. The method defined in claim 1 further comprising the step of monitoring the torque on the collet as the package builds.

3. The method defined in claim 2, wherein the torque on the collet falls between an upper operating curve and a lower operating curve of collet torque as a function of package diameter.

4. The method defined in claim 3 wherein the upper and lower operating curves for the torque on the collet are non-linear.

5. A method of controlling strand guide position during package buildup, the method comprising the steps of:

rotating a collet for building a package;

rotating a cam having a strand guide for winding a strand on the rotating collet;

moving the rotating cam with a receder toward the rotating collet until the strand guide contacts the rotating collet;

determining a torque on one of the collet, the cam and the receder as the strand guide contacts the collet; and moving the rotating cam radially away from the rotating collet until a predetermined torque on one of the collet, the cam and the receder is reached.

6. The method defined in claim 5 further comprising the step of monitoring the torque on one of the collet, the cam and the receder as the package builds.

7. The method defined in claim 6, wherein the torque on one of the collet, the cam and the receder falls between an upper operating curve and a lower operating curve of torque as a function of package diameter.

8. The method defined in claim 7 wherein the upper and lower operating curves for the torque on one of the collet, the cam and the receder are non-linear.

* * * * *